US010493649B2

(12) United States Patent
Yoshihara et al.

(10) Patent No.: US 10,493,649 B2
(45) Date of Patent: Dec. 3, 2019

(54) ANVIL ROLL, ROTARY CUTTER, AND METHOD FOR CUTTING WORKPIECE

(71) Applicant: NIPPON TUNGSTEN CO., LTD., Fukuoka-shi, Fukuoka (JP)

(72) Inventors: Takahiro Yoshihara, Fukuoka (JP); Shigeki Mouri, Fukuoka (JP)

(73) Assignee: NIPPON TUNGSTEN CO., LTD., Fukuoka (JP)

( * ) Notice: Subject to any disclaimer, the term of this patent is extended or adjusted under 35 U.S.C. 154(b) by 0 days.

(21) Appl. No.: 15/723,844

(22) Filed: Oct. 3, 2017

(65) Prior Publication Data

US 2018/0311852 A1 Nov. 1, 2018

(30) Foreign Application Priority Data

Apr. 27, 2017 (JP) ..... 2017-088643

(51) Int. Cl.
*B26D 7/20* (2006.01)
*B26F 1/38* (2006.01)
*B26F 1/44* (2006.01)

(52) U.S. Cl.
CPC ..... *B26D 7/204* (2013.01); *B26F 1/384* (2013.01); *B26F 1/44* (2013.01); *B26F 2001/4436* (2013.01)

(58) Field of Classification Search
CPC .... B26D 7/204; B26D 7/2614; B26D 7/2621; B26D 7/2628; B26D 7/2635
See application file for complete search history.

(56) References Cited

U.S. PATENT DOCUMENTS 3,647,401 A * 3/1972 Meadows ..... C22C 29/08 75/229
3,660,050 A * 5/1972 Iler ..... C22C 29/067 75/240
3,949,035 A * 4/1976 Dunning ..... D21H 5/26 264/101
4,080,091 A * 3/1978 Hollingshead ..... E21B 10/18 175/340
5,421,852 A * 6/1995 Maruyama ..... C22C 29/08 75/239

(Continued)

FOREIGN PATENT DOCUMENTS

CN 1733378 A 2/2006
CN 1890396 A 1/2007

(Continued)

OTHER PUBLICATIONS

Materials & Design vol. 22, Issue 6, Sep. 2001, pp. 483-489 (Year: 2001).*

(Continued)

*Primary Examiner* — Andrea L Wellington
*Assistant Examiner* — Richard D Crosby, Jr.
(74) *Attorney, Agent, or Firm* — Oliff PLC

(57) ABSTRACT

A rotary cutter includes a die cut roll having a cutting blade, and an anvil roll positioned so that a roll surface faces the cutting blade. The roll surface of the anvil roll is made of a hard material including at least either cemented carbide or cermet. The Young's modulus of the hard material is between 300 GPa and 400 GPa. The Vickers hardness (Hv) of the hard material is 800 or more.

7 Claims, 7 Drawing Sheets

(56) References Cited

U.S. PATENT DOCUMENTS 6,537,343 B2 * 3/2003 Majagi ..... B22F 3/156 75/240
7,179,319 B2 * 2/2007 Heinrich ..... C22C 1/053 428/545
7,384,443 B2 * 6/2008 Mirchandani ..... C22C 1/051 75/236
8,007,922 B2 * 8/2011 Mirchandani ..... B22F 7/062 175/425
8,459,246 B2 * 6/2013 Kasashima ..... B23D 61/028 125/15
2002/0029675 A1 * 3/2002 Aichele ..... B26D 7/2614 83/506
2005/0221102 A1 * 10/2005 Tatsuda ..... B23K 1/0008 428/472
2005/0276717 A1 * 12/2005 Fang ..... B22F 7/02 419/14
2007/0266833 A1 * 11/2007 Radziszewski ..... B23D 59/001 83/13
2010/0011949 A1 * 1/2010 Ravid ..... F41H 5/0492 89/36.02
2011/0174125 A1 * 7/2011 Funabiki ..... B21D 28/02 83/13
2015/0203980 A1 * 7/2015 Erdemir ..... C25D 3/66 428/698
2015/0376744 A1 * 12/2015 Konyashin ..... C22C 26/00 51/309

FOREIGN PATENT DOCUMENTS

CN 101605919 A 12/2009
JP H03-246000 A 11/1991
JP H11-077586 A 3/1999
JP H11-188700 A 7/1999
JP 200228898 A 1/2002
JP 4324388 B2 9/2009
JP 2012055974 A 3/2012
JP 2012143824 A 8/2012
JP WO 2013125308 A1 * 8/2013 ..... C22C 29/08
KR 1020080053999 A 6/2008

OTHER PUBLICATIONS

Jul. 4, 2017 Notice of Reasons for Rejection issued in Japanese Application No. 2017-088643.
Sep. 5, 2017 Notice of Decision to Grant issued in Japanese Application No. 2017-088643.

* cited by examiner

ANVIL ROLL, ROTARY CUTTER, AND METHOD FOR CUTTING WORKPIECE

CROSS-REFERENCE TO RELATED APPLICATIONS

This application is based upon and claims the benefit of priority from Japanese Patent Application No. 2017-088643, filed Apr. 27, 2017, the entire contents of which are incorporated herein by reference.

TECHNICAL FIELD

The present disclosure relates to an anvil roll, a rotary cutter, and a method of cutting a workpiece.

BACKGROUND

A rotary cutter for cutting a workpiece into a desired shape by inserting the workpiece between a cutting blade of a die cut roll and an anvil roll has been known. A hard material is used for the cutting blade of the rotary cutter and for the anvil roll to improve wear resistance.

Japanese Unexamined Patent Publication No. 2012-143824 proposes an anvil having a structure composed of two or more layers of an internal base member and a working surface layer to prevent the cutting edge from being chipped (broken) during the initial operation of the cutter. This publication discloses preventing chipping of the cutting edge during the initial operation by covering the internal base member using a material having a low Young's modulus with the working surface layer of a predetermined thickness using a material having a high Young's modulus.

SUMMARY

A rotary cutter for use in cutting a workpiece is required to sufficiently reduce chipping of the cutting edge of a cutting blade to further prolong the life. Here, from the viewpoint of improving the wear resistance of an anvil roll, it is effective to use a hard material having high hardness. On the other hand, as the hardness of the anvil roll increases, Young's modulus thereof tends to increase in a conventional art. As the result, the cutting edge of the cutting blade tends to chip easily.

Therefore, it is an object of the present disclosure to provide an anvil roll capable of reducing chipping of the cutting edge while having wear resistance. Another object is to provide a rotary cutter capable of reducing chipping of a cutting edge while having an anvil roll with wear resistance. A further object is to provide a method of cutting a workpiece, capable of reducing chipping of the cutting edge while reducing the wear of the anvil roll.

In one aspect, the present disclosure provides an anvil roll comprising a roll surface made of a hard material including at least either cemented carbide or cermet, the hard material having a Young's modulus of between 300 GPa and 400 GPa.

Since the above anvil roll has the roll surface made of a hard material, it has excellent wear resistance. The above hard material has a Young's modulus of between 300 GPa and 400 GPa. Since the roll surface is made of such a hard material, it is possible to reduce the occurrence of chipping of the cutting blade even when the cutting blade continuously or intermittently makes contact with the roll surface and a workpiece at the time of cutting the workpiece.

In another aspect, the present disclosure provides a rotary cutter comprising a die cut roll having a cutting blade, and the above anvil roll positioned so that the roll surface faces the cutting blade.

Since the anvil roll provided in the rotary cutter has the roll surface made of a hard material, it has excellent wear resistance. The hard material constituting the roll surface of the anvil roll has a Young's modulus of between 300 GPa and 400 GPa. Since the roll surface is made of such a hard material, even if the cutting blade of the die cut roll continuously or intermittently makes contact with a workpiece, or the workpiece and the roll surface of the anvil roll, at the time of cutting the workpiece, it is possible to reduce the occurrence of chipping of the cutting blade.

In the above rotary cutter, the ratio of the Young's modulus of the hard material constituting the cutting blade to the Young's modulus of the hard material constituting the roll surface of the anvil roll may be 1.3 or more.

In yet another aspect, the present disclosure provides a method of cutting a workpiece, comprising a cutting step of pressing a cutting blade of a die cut roll against a workpiece on the roll surface of the above anvil roll to cut the workpiece. Since this anvil roll has a roll surface made of a hard material, it has excellent wear resistance. Additionally, even if the cutting blade of the die cut roll continuously or intermittently makes contact with the roll surface of the anvil roll in the cutting step, it is possible to reduce the occurrence of chipping of the cutting edge of the cutting blade.

According to the present disclosure, it is possible to provide an anvil roll capable of reducing chipping of the cutting edge of the cutting blade while having wear resistance. Moreover, it is possible to provide a rotary cutter capable of reducing chipping of the cutting edge of the cutting blade while having an anvil roll with wear resistance. Furthermore, it is possible to provide a method of cutting a workpiece capable of reducing chipping of the cutting edge of the cutting blade while reducing the wear of the anvil roll.

DETAILED DESCRIPTION

Figure 1:
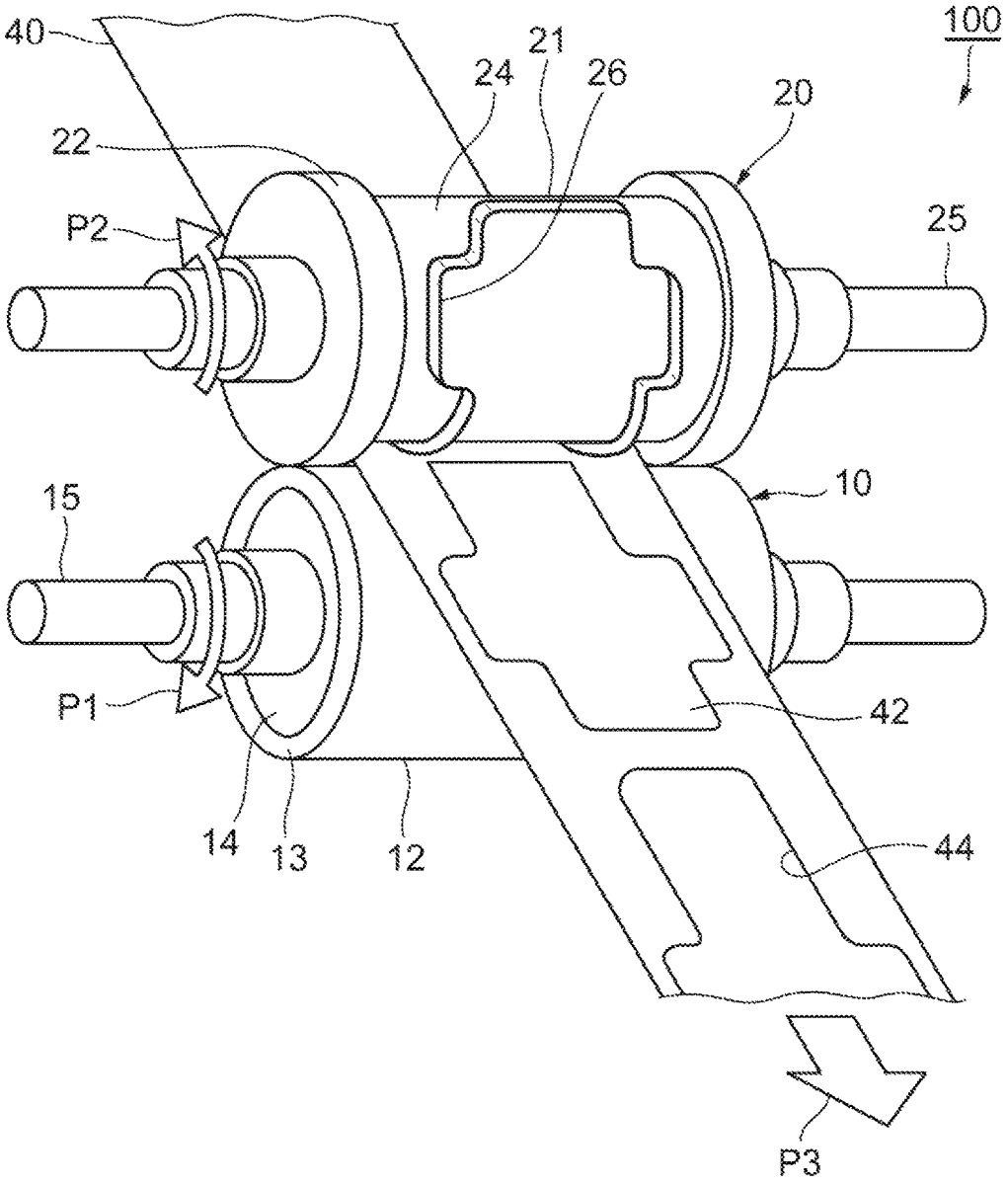
FIG. 1 is a schematic view of a rotary cutter.

The following will describe embodiments of the present disclosure with reference to the drawings if occasion arises. It should be noted that the following embodiments are examples for explaining the present disclosure.

In the description, the same reference numerals are used for the same elements or elements having the same functions, and redundant description will be omitted in some cases. Moreover, the positional relationships such as up, down, left, and right are based on the positional relationships shown in the drawings unless otherwise noted. Further, the dimensional ratio of the respective elements is not limited to the ratio in the drawings.

FIG. 1 is a schematic view of a rotary cutter of this embodiment. A rotary cutter 100 of FIG. 1 includes an anvil roll 10 and a die cut roll 20. The anvil roll 10 and the die cut roll 20 have a shaft 15 and a shaft 25, respectively. The anvil roll 10 and the die cut roll 20 are positioned so that the shaft 15 and the shaft 25 are parallel to each other.

The anvil roll 10 includes a base member 14 having a substantially cylindrical shape, and a surface layer 13 covering the outer circumferential surface of the base member 14. The base member 14 and the surface layer 13 may be made of the same material or different materials. The surface layer 13 is made of a hard material including at least either cemented carbide or cermet. In other words, a roll surface 12 (outer circumferential surface) of the anvil roll 10 is made of the hard material.

Examples of cemented carbide included in the hard material in the surface layer 13 are WC—Co based alloy, WC—TiC—Co based alloy, WC—TaC—Co based alloy, WC—TiC—TaC—Co based alloy, WC—Ni based alloy, and WC—Ni—Cr based alloy. Among them, from the viewpoint of sufficiently increasing hardness and strength, the hard material may be WC—Co based alloy. On the other hand, from the viewpoint of sufficiently reducing chipping, the hard material may be a WC—Ni based alloy.

Examples of cermet included in the hard material include cermet containing at least one selected from the group consisting of Mo, Ni and Ti as a metal component and at least either carbide or nitride as a ceramic component. An example of carbide is TiC. An example of nitride is TiN. The metal contained in the cermet may be an alloy containing at least one selected from the group consisting of Mo, Ni and Ti. The ceramics included in the cermet may be a solid solution containing at least either carbide or nitride.

The Young's modulus of the hard material constituting the roll surface 12 of the anvil roll 10 is between 300 GPa and 400 GPa. The anvil roll 10 having the surface layer 13 constituted by the hard material with such a Young's modulus has excellent wear resistance and can reduce chipping of the cutting edge of the cutting blade 26. Therefore, it can be used suitably as an anvil roll for a rotary cutter. From the viewpoint of further increasing the wear resistance, the Young's modulus of the hard material may be 310 GPa or more, or 320 GPa or more. From the viewpoint of sufficiently reducing chipping, the Young's modulus of the hard material may be less than 380 GPa, or less than 350 GPa.

The Young's modulus in the present disclosure is measured by a three-point bending test specified in JIS R 1601, using a measurement specimen processed into a quadrangular prism with height×width×length=3×4×40 (mm). It is possible to measure the Young's modulus by a nanoindentation method as well to confirm the measurement accuracy of the Young's modulus by the three-point bending test.

The Vickers hardness (Hv) of the hard material constituting the roll surface 12 of the anvil roll 10 may be, for example, 800 or more, or 1000 or more. By sufficiently increasing the Vickers hardness (Hv), it is possible to sufficiently increase the wear resistance of the anvil roll 10. The Vickers hardness in the present disclosure can be measured using a Vickers hardness tester.

The Rockwell hardness (HRA) of the hard material constituting the roll surface 12 of the anvil roll 10 may be 83.4 or more, or may be 85 or more. The Rockwell hardness (HRA) in the present disclosure can be measured using a commercially available Rockwell hardness tester. In the present disclosure, Vickers hardness and Rockwell hardness are collectively referred to as "hardness".

The value of fracture toughness of the hard material constituting the roll surface 12 of the anvil roll 10 may be 10 $MPa \cdot m^{1/2}$ or more, or 12 $MPa \cdot m^{1/2}$ or more. Accordingly, the durability of the anvil roll 10 is made sufficiently high. The value of fracture toughness can be measured using a commercially available measuring device according to the Indentation-Fracture method (IF method) of JIS R1607: 2010.

The Young's modulus, hardness and value of fracture toughness of the hard material constituting the roll surface 12 can be adjusted depending on the composition and porosity of the surface layer 13, etc. For example, when the ratio of a binder phase (for example, Co) to a hard phase (for example, WC) in the hard material increases, the Young's modulus and hardness tend to decrease and the value of fracture toughness tends to increase. When the porosity of the hard material increases, the Young's modulus tends to decrease.

For example, in the case of WC—Co based cemented carbide, the porosity may be 4 to 15 volume % or 5 to 10.5 volume %. When the porosity becomes too large, the strength tends to be low. On the other hand, when the porosity becomes too small, chipping of the blade tends to occur easily. The porosity of the hard material can be determined by observing a polished surface obtained by lapping a cross section of the surface layer 13 with a scanning electron microscope (SEM) or an optical microscope and performing image analysis of the image.

Figure 2:
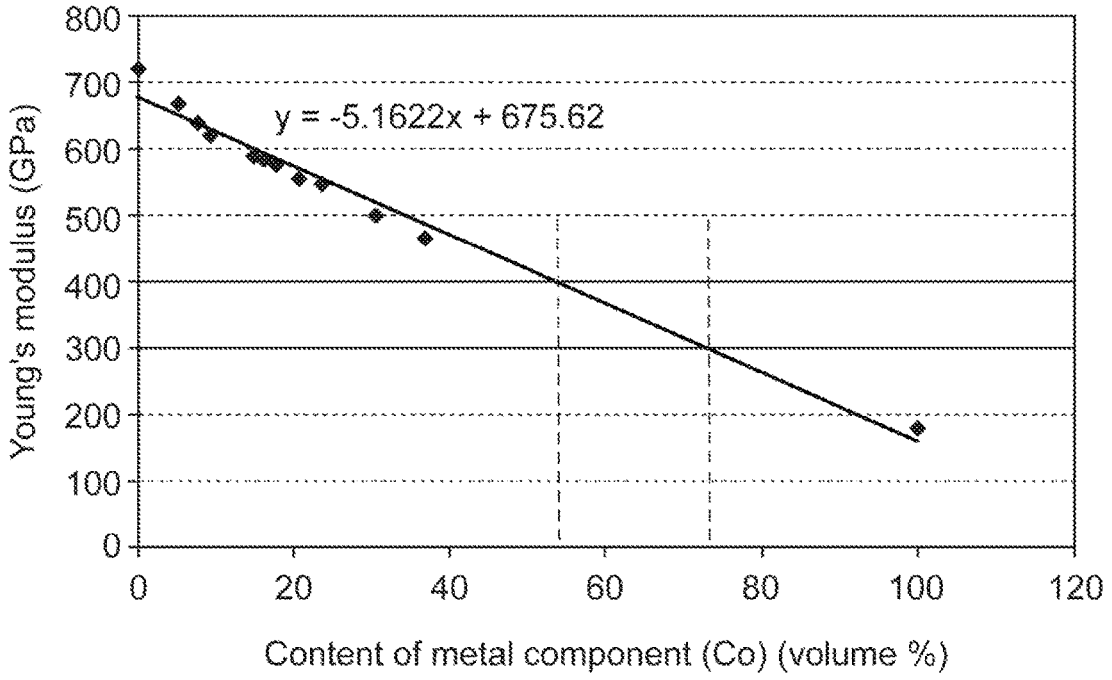
FIG. 2 is a view showing the relationship between the content of a metal component and Young's modulus in WC—Co based cemented carbide.
Figure 3:
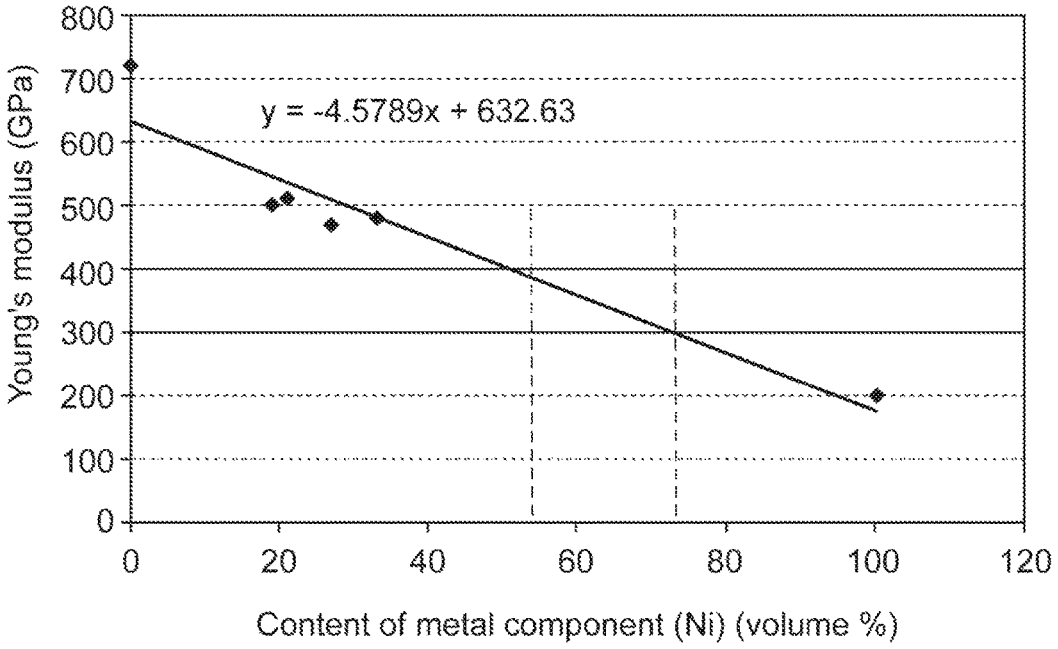
FIG. 3 is a view showing the relationship between the content of a metal component and Young's modulus in WC—Ni based cemented carbide.

FIG. 2 is a view showing the relationship between the content of a metal component (Co) and Young's modulus in WC—Co based cemented carbide. FIG. 3 is a view showing the relationship between the content of a metal component (Ni) and Young's modulus in WC—Ni based cemented carbide.

As shown in FIGS. 2 and 3, it is possible to adjust Young's modulus by changing the content of the metal component in the hard material. For example, when the hard material is cemented carbide, the content of a binder phase may be between about 50 volume % and 73 volume %. Thus, by adjusting the content of the binder phase to be larger than that in a general composition, it is possible to easily adjust the Young's modulus. It should be noted that the composition of the hard material is not limited to the above example, and the Young's modulus may be adjusted within a predetermined range by adjusting the porosity in the hard material as well as the composition. Even in the case where the hard material is cermet, it is possible to use a material with Young's modulus adjusted to be between 300 GPa and 400 GPa.

Returning to FIG. 1, the thickness of the surface layer 13 is not particularly limited, and, for example, may be between 1 mm and 10 mm. The surface layer 13 may be in the form of a film. In some other embodiments, the base member 14 and the surface layer 13 of the anvil roll 10 may be composed of one member. In this case, the base member 14 and the surface layer 13 are made of a hard material.

The materials of the base member 14 and the shaft 15 of the anvil roll 10 are not limited, and, for example, may be alloy steels (hot work tool steel, cold work tool steel, heat resistant steel, high tensile steel, chromium steel, chromium molybdenum steel, nickel chromium steel, nickel chromium molybdenum steel, or manganese molybdenum steel), or tool steels (carbon tool steel, alloy tool steel, die steel or high speed steel).

It is possible to form the surface layer 13 of the anvil roll 10 by a powder metallurgical technique. For example, the surface layer 13 in the form of a cylinder may be formed by pressure molding and sintering a powder having a predetermined composition. Thereafter, the anvil roll 10 is obtained by so-called shrink fitting in which the base member 14 is inserted into the heated surface layer 13. The method of manufacturing the anvil roll 10 is not limited to this, and the anvil roll 10 may be manufactured by a method such as cold fitting or press fitting. The surface layer 13 may be formed by coating the base member 14 with a hard material by a thermal spray method or a cold spray method. Alternatively, the surface layer 13 may be formed by gasifying and depositing a hard material on the base member 14. The surface layer 13 may be formed by liquid coating deposition like plating.

The anvil roll 10 and the die cut roll 20 are positioned so that a roll surface 24 of the die cut roll 20 and the roll surface 12 of the anvil roll 10 face each other. A cutting blade 26 is mounted on a central portion 21 of the roll surface 24 of the die cut roll 20. The cutting blade 26 is made of a hard material such as cemented carbide or ceramics. From the viewpoint of the life of the cutting blade 26, the hardness of the hard material constituting the cutting blade 26 is preferably greater than the hardness of the hard material constituting the roll surface 12 of the anvil roll 10. The Vickers hardness (HV) of the cutting blade 26 may be, for example, 1200 or more, or may be 1400 or more.

From the viewpoint of further reducing chipping of the cutting edge of the cutting blade 26, the ratio of the Young's modulus of the hard material constituting the cutting blade 26 to the Young's modulus of the hard material constituting the roll surface 12 of the anvil roll 10 may be, for example, 1.3 or more, or may be 1.5 or more. From the viewpoint of improving the durability of the anvil roll 10 and the cutting blade 26, the ratio of the Rockwell hardness (HRA) of the hard material constituting the cutting blade 26 to the Rockwell hardness (HRA) of the hard material constituting the roll surface 12 of the anvil roll 10 may be between 1.0 and 1.2, or may be between 1.0 and 1.1.

The die cut roll 20 has the cutting blade 26 on the roll surface 24 (outer circumferential surface). The die cut roll 20 has at both ends an outer edge portion 22 with an outside diameter larger than that of the central portion 21. The die cut roll 20 rotates in the direction of arrow P2 while the outer edge portions 22 are in contact with the roll surface 12 of the anvil roll 10. On the other hand, since the central portion 21 located on the inner side than the outer edge portions 22 has an outside diameter smaller than that of the outer edge portions 22, there is a gap between the roll surface 24 in the central portion 21 and the roll surface 12 of the anvil roll 10.

When the anvil roll 10 rotates in the direction of arrow P1 and the die cut roll 20 rotates in the direction of arrow P2, a belt-like workpiece 40 (a member to be cut) passes through between the roll surface 24 in the central portion 21 and the roll surface 12. Here, since the cutting blade 26 is mounted on the roll surface 24, when the workpiece 40 passes through between the roll surface 24 and the roll surface 12, the workpiece 40 is cut by the cutting blade 26. The belt-like workpiece 40 is cut out into a predetermined shape by the cutting blade 26. By such a press cutting process, a cut member 42 is produced. The shape of the cut member 42 is not particularly limited, and the belt-like workpiece 40 can be cut out into various shapes, depending on the shape of the cutting blade 26. A cutout portion 44 corresponding to the shape of the cut member 42 is formed in the workpiece 40 from which the cut member 42 was cut out.

Cutting of the workpiece 40 by the rotary cutter 100 is not limited to the press cutting process. In some other embodiments, the belt-like workpiece 40 are cut into strips. In this case, the cut member has a strip shape.

The shaft 15 is the rotation center of the anvil roll 10. The shaft 15 is rotatably supported by, for example, a bearing (not shown). The shaft 25 is the rotation center of the die cut roll 20. The shaft 25 is also rotatably supported by, for example, a bearing (not shown). The mechanism for rotatably driving the anvil roll 10 and the die cut roll 20 is not particularly limited. For example, one end of each of the shaft 15 or the shaft 25 may be connected to a rotary motor. The other end of each of the shaft 15 and the shaft 25 may be gear-connected so that the shaft 15 and the shaft 25 rotate in mutually opposite directions. A control unit for adjusting the rotational speeds of the shaft 15 and the shaft 25 may be connected to the motor.

Figure 4:
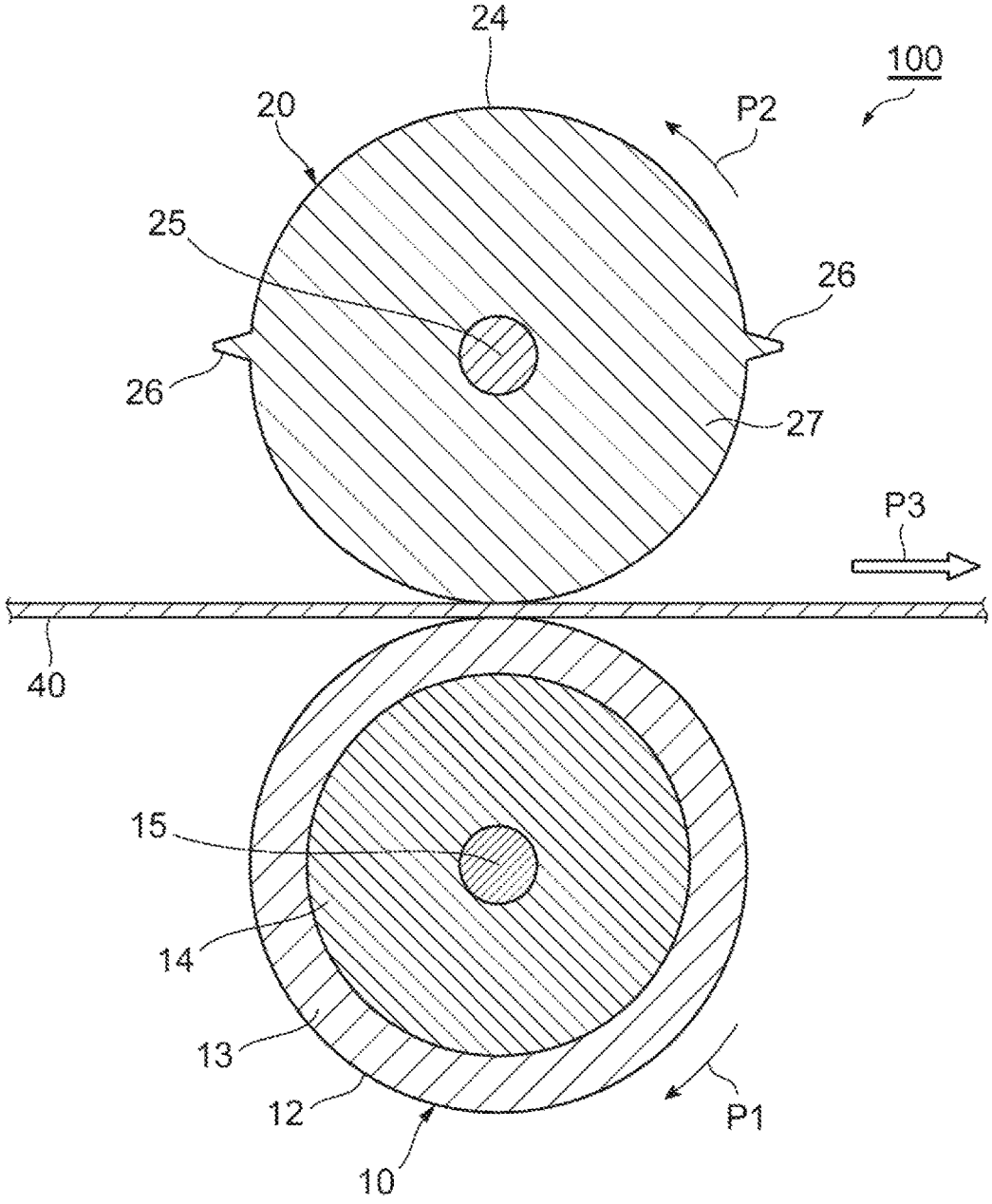
FIG. 4 is a cross sectional view of the rotary cutter.

FIG. 4 is a cross-sectional view of the rotary cutter 100 schematically showing a cross section when the anvil roll 10 and the die cut roll 20 are respectively cut in the radial direction. The workpiece 40 passes through between the anvil roll 10 and the die cut roll 20 and moves in the direction of arrow P3. When the workpiece 40 passes through between the anvil roll 10 and the die cut roll 20, a cut is made in the workpiece 40 by the cutting blade 26 mounted on the roll surface 24 of the die cut roll 20. With the rotation of the anvil roll 10 and the die cut roll 20 and the movement of the workpiece 40, the cut progresses and a cutout process (a cutting process) of the workpiece 40 is applied.

Figure 5:
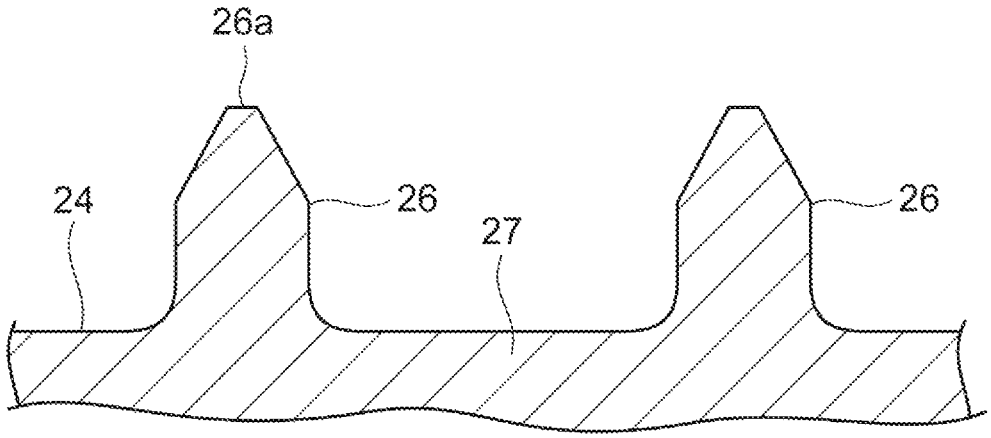
FIG. 5 is an enlarged cross-sectional view illustrating a section of a cutting blade of a die cut roll and the vicinity thereof.

FIG. 5 is an enlarged cross-sectional view illustrating the cutting blade 26 and the vicinity thereof when the die cut roll 20 is cut along the axial direction passing through the cutting blade 26. In the present embodiment, it is possible to reduce chipping of a cutting edge 26*a* of the cutting blade 26. The cutting blade 26 may be formed integrally with a roll main body 27 of the die cut roll 20. In this case, the cutting blade 26 and the roll main body 27 are made of the same material. It is possible to manufacture such a die cut roll 20 by a powder metallurgical technique.

The cutting blade 26 may be attached to the roll main body 27 as a separate member from the roll main body 27. In some other embodiments, like the anvil roll 10, it is possible to manufacture the roll main body 27 by producing a base member and a surface layer having a cutting blade separately and shrink-fitting, cold fitting or press-fitting the base member into the surface layer having a substantially cylindrical shape. The roll main body 27 may be made of an iron-based material such as, for example, tool steels.

The rotary cutter 100 is capable of reducing chipping of the cutting edge 26*a* while having the anvil roll 10 with wear resistance. The anvil roll 10 of the rotary cutter 100 is capable of reducing chipping of the cutting edge 26*a* while having wear resistance.

A cutting method of cutting the belt-like workpiece 40 using the rotary cutter 100 includes a cutting step of cutting the workpiece 40 by pressing the cutting blade 26 of the die cut roll 20 against the workpiece 40 on the roll surface 12 of the anvil roll 10. Examples of the workpiece 40 include a thin plate or a foil of nonwoven fabric, cloth, paper, plastic, resin, carbon, and metal foil. This cutting method is executed based on the contents of description of the above rotary cutter 100.

According to the above cutting method, it is possible to reduce chipping of the cutting edge 26*a* while keeping the wear resistance of the anvil roll 10. Therefore, it is possible to stably perform the cutting process of the workpiece 40 and stably continue the production of the cut member 42.

Several embodiments of the present disclosure have been described above, but it is not limited to the above embodiments at all. For example, the anvil roll may have an optional intermediate layer between the surface layer and the base member. Like the anvil roll, the die cut roll may have a surface layer and a base member, or may have an intermediate layer.

EXAMPLES

The contents of the present invention will be described in more detail with reference to examples and comparative examples. However, it is not limited to the following examples.

Example 1

A surface layer (thickness: 1.5 mm) made of WC-20 volume % Co based cemented carbide (corresponding to VM-50 in CIS 019D (Cemented Carbide Tool Industrial Standard) classification) was formed on a substrate by a thermal spray method in which WC powder and Co powder collide against the substrate at high speeds.

The density, porosity (pore volume), Young's modulus, Vickers hardness and the value of fracture toughness of the surface layer were measured. The Young's modulus was measured using a commercially available three-point bending tester (Shimadzu Corporation, product name: Autograph material testing machine). The Vickers hardness was measured using a commercially available measuring device (manufactured by AKASHI Corporation, product name: MODEL AVK No. 230959). The value of fracture toughness was measured using the same device, according to the Indentation-Fracture method (IF method) of JIS R1607: 2010. The porosity was determined by observing a polished surface obtained by lapping a cross section of the surface layer with a scanning electron microscope (SEM) and performing image analysis of the image. The results are shown in Table 1.

Comparative Examples 1 to 4

Comparative Example 1 is a sintered body of cemented carbide (WC-20 volume % Co based alloy). The Young's modulus and physical property values of the cemented carbide are shown in Table 1. The cemented carbide of Comparative Example 1 included substantially no pores. Comparative Examples 2 to 4 are WC-20 volume % Co based cemented carbides prepared by a sintering method. In Comparative Examples 2 to 4, pores were intentionally included by adjusting the amount of organic substance scattered into the material during the production of the cemented carbide. The porosity, Young's modulus and other physical properties of each cemented carbide were measured, and the results are shown in Table 1.

TABLE 1

| | Density g/cm$^3$ | Porosity (volume %) | Young's modulus GPa | Vickers hardness Hv | Fracture toughness MPa · m$^{1/2}$ |
|---|---|---|---|---|---|
| Example 1 | 12.7 | 9.0 | 337 | 1251 | 13.63 |
| Comparative Example 1 | 14.3 | 0.0 | 550 | 1260 | 17.41 |

TABLE 1-continued

| | Density g/cm$^3$ | Porosity (volume %) | Young's modulus GPa | Vickers hardness Hv | Fracture toughness MPa · m$^{1/2}$ |
|---|---|---|---|---|---|
| Comparative Example 2 | 14.2 | 0.6 | 436 | 1179 | 18.64 |
| Comparative Example 3 | 14.2 | 1.3 | 442 | 1183 | 18.40 |
| Comparative Example 4 | 14.2 | 2.5 | 439 | 1186 | 18.19 |

Figure 6:
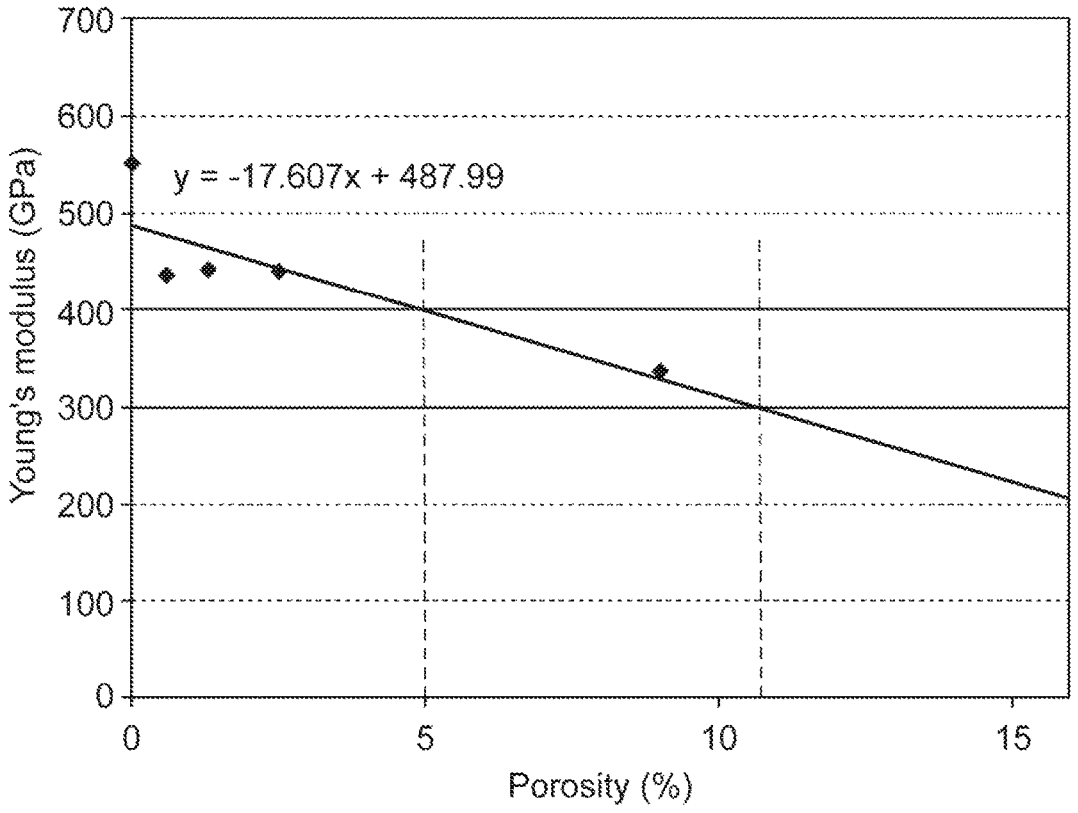
FIG. 6 is a graph showing the relationship between porosity and Young's modulus.

As shown in Table 1, the surface layer of Example 1 with the highest porosity had the lowest Young's modulus, but had the Vickers hardness equal to that of Comparative Example 1. FIG. 6 is a graph showing the relationship between porosity and Young's modulus. From the results shown in FIG. 6, it is considered that in the case of WC-20 volume % Co based cemented carbide, if the porosity is in the range of 5 to 10.5%, the Young's modulus will be in the range of between 300 GPa and 400 GPa.

Example 2

A surface layer (WC-20 volume % Co based cemented carbide) was formed on the outer circumferential surface of a columnar iron-based base member having a rotating shaft by the same thermal spray method as in Example 1. The thickness of the surface layer was about 1 mm, and the porosity was about 9 volume %.

A die cut roll having a cutting blade of a predetermined shape was produced on the surface of the central portion of a roll main body having a rotating shaft. The cutting blade was formed using a cemented carbide material (VF-40 class material in CIS 019D classification). The physical properties of the hard material constituting the roll surface of the anvil roll and the cutting blade were measured in the same manner as in Example 1. The measurement results are shown in Table 2. The Rockwell hardness (HRA) of the cutting blade was 90.0. This value corresponds to Vickers hardness (Hv) of about 1450.

A rotary cutter as shown in FIG. 1 was produced using the above-mentioned anvil roll and die cut roll. Cutting process of a nonwoven fabric workpiece was intermittently performed as a chipping evaluation test with the use of this rotary cutter. Intermittent operations are conditions under which initial chipping is likely to occur. In this evaluation test, the rotary cutter was operated under high load conditions from the beginning. In ordinary cutting process, the initial load was 100 kgf at the maximum, while in this evaluation test, the load was set at 1500 kgf from the beginning. After cutting process, the presence or absence of chipping in the cutting edge of the cutting blade was confirmed by eyes. The results are shown in Table 2.

Example 3

An anvil roll was obtained by forming a surface layer made of a sintered body of WC-60 volume % Co based cemented carbide on the outer circumferential surface of a columnar iron-based base member having a rotating shaft. The physical properties of the roll surface of the anvil roll were measured in the same manner as in Example 2. The measurement results are shown in Table 2. A rotary cutter as shown in FIG. 1 was produced in the same manner as in Example 2 except that the surface layer was formed as described above, and a chipping evaluation test was performed. The results are shown in Table 2.

Comparative Example 5

A cylinder was formed using a sintered body of WC-30 volume % Co (corresponding to VM-50 class in CIS 019D classification) as a cemented carbide material on the outer circumferential surface of a columnar iron-based base member having a rotating shaft, and thereby an anvil roll was obtained. The physical properties of the roll surface of the anvil roll thus obtained were measured in the same manner as in Example 2. The measurement results are shown in Table 2. The Rockwell hardness (HRA) of the anvil roll shown in Table 2 was 88.0. This value corresponds to Vickers hardness (Hv) of about 1200. The porosity of the surface layer was almost 0%.

A die cut roll was produced by forming a cutting blade of the same shape as in Example 2 on the surface of the central portion of a roll main body having a rotating shaft. The cutting blade was formed using a cemented carbide material (corresponding to VF-40 class in CIS 019D classification). The physical properties of the cutting blade were measured in the same manner as in Example 2. The Rockwell hardness (HRA) of the cutting blade shown in Table 2 is about 1700 when converted to Vickers hardness (Hv). The Rockwell hardness (HRA) of the cutting blade shown in Table 2 was 92.0. This value corresponds to Vickers hardness (Hv) of about 1700.

A rotary cutter similar to that of Example 2 was produced using such an anvil roll and a die cut roll, and the presence or absence of chipping in the cutting edge after cutting was confirmed. The results are shown in Table 2.

Comparative Example 6

A rotary cutter similar to that of Example 2 was produced using the anvil roll produced in Comparative Example 5 and the die cut roll produced in Example 2, and the presence or absence of chipping in the cutting edge after cutting was confirmed. The results are shown in Table 2.

Comparative Example 7

An anvil roll was obtained by forming a surface layer on the outer circumferential surface of a columnar iron-based base member having a rotating shaft by using a cemented carbide material (corresponding to VM-50 class in CIS 019D classification). The surface layer was composed of WC-30 volume % Co based cemented carbide. The physical properties of the roll surface of the anvil roll were measured in the same manner as in Example 2. The measurement results are shown in Table 2. The Rockwell hardness (HRA) of the anvil roll shown in Table 2 was 86.5. This value corresponds to Vickers hardness (Hv) of about 1050. The porosity of the surface layer was almost 0%.

A rotary cutter similar to that of Example 2 was produced using this anvil roll and the die cut roll produced in Example 2, and the presence or absence of chipping in the cutting edge after cutting was confirmed. The results are shown in Table 2.

TABLE 2

| | Anvil roll | | Cutting blade | | | | |
|---|---|---|---|---|---|---|---|
| | Young's modulus GPa | Hardness HRA | Young's modulus GPa | Hardness HRA | Young's modulus ratio | Hardness ratio | Presence of chipping |
| Example 2 | 330 | 86.2 | 540 | 90.0 | 1.64 | 1.04 | No |
| Example 3 | 370 | — | 540 | 90.0 | 1.46 | — | No |
| Comparative Example 5 | 549 | 88.0 | 510 | 92.0 | 0.93 | 1.05 | Yes |
| Comparative Example 6 | 549 | 88.0 | 540 | 90.0 | 0.98 | 1.02 | Yes |
| Comparative Example 7 | 510 | 86.5 | 540 | 90.0 | 1.06 | 1.04 | Yes |

The term, "Young's modulus ratio" shown in Table 2 means the ratio of the Young's modulus of the hard material constituting the cutting blade with respect to the Young's modulus of the hard material constituting the roll surface of the anvil roll. The term, "Hardness ratio" shown in Table 2 means the ratio of the Rockwell hardness of the hard material constituting the cutting blade with respect to the Rockwell hardness of the hard material constituting the roll surface of the anvil roll. It was confirmed that the rotary cutters of Examples 2 and 3 are capable of sufficiently reducing the occurrence of chipping as compared with Comparative Examples 5 to 7.

Comparative Example 8

Figure 7:
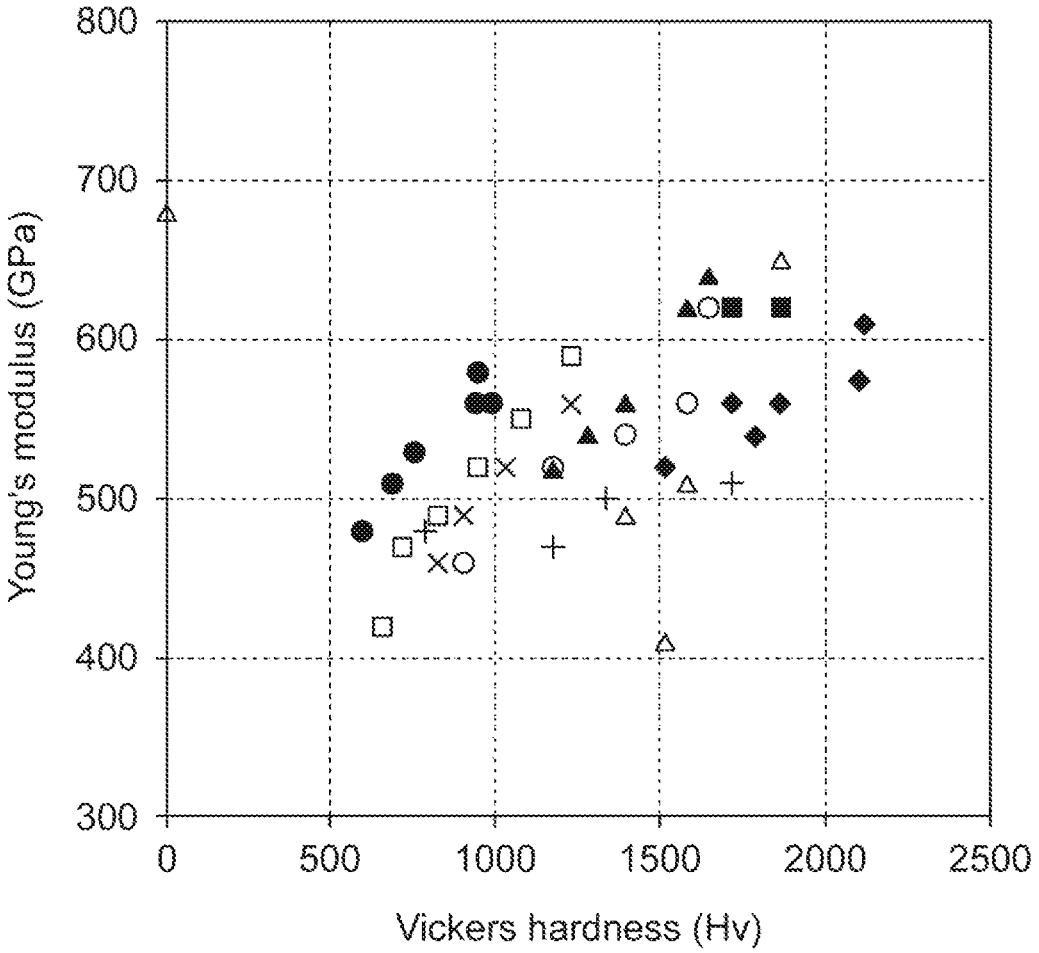
FIG. 7 is a view showing the relationship between Vickers hardness and Young's modulus of commercially available hard materials.

FIG. 7 shows the relationship between Vickers hardness and Young's modulus of commercially available cemented carbides. FIG. 7 shows different types of plots depending on the sizes and applications of hard phase particles in the cemented carbides. The data shown in FIG. 7 include data (plotted by black triangles) about cemented carbide for general wear resistance (corresponding to "VF-10", "VF-20", "VF-30", "VF-40" in the CIS 019D classification). Also included are data (plotted by "x" marks) about cemented carbide for wear resistance and impact resistance (corresponding to "VC-40", "VC-50", "VC-60" in CIS 019D classification). The Young's modulus of each data plotted in FIG. 7 exceeded 400 GPa.

What is claimed is:

1. An anvil roll comprising a roll surface made of a hard material including a cemented carbide containing WC and at least one selected from the group consisting of Co and Ni, the hard material having:

(i) a Young's modulus of between 300 GPa and 400 GPa, (ii) a value of fracture toughness of 10 $MPa \cdot m^{1/2}$ or more, (iii) a Vickers hardness (Hv) of 1,000 or more, and (iv) a porosity in a range of from 4 vol % to 15 vol %.

2. A rotary cutter comprising:

a die cut roll having a cutting blade; and the anvil roll according to claim 1, the anvil roll being positioned so that the roll surface faces the cutting blade.

3. The rotary cutter according to claim 2, wherein a ratio of a Young's modulus of a hard material constituting the cutting blade with respect to the Young's modulus of the hard material constituting the roll surface of the anvil roll is 1.3 or more.

4. The anvil roll according to claim 1, wherein a content of a binder phase in the hard material is in a range of from about 50 vol % to 73 vol %.

5. The anvil roll according to claim 1, wherein the Young's modulus is in a range of from 330 GPa to 370 GPa.

6. A rotary cutter comprising:

a die cut roll having a cutting blade; and an anvil roll positioned so that a roll surface faces the cutting blade, wherein the roll surface is made of a first hard material including a cemented carbide containing WC and at least one selected from the group consisting of Co and Ni, the first hard material has (i) a Vickers hardness (Hv) of 1,000 or more, (ii) a Young's modulus of between 300 GPa and 400 GPa (iii) a value of fracture toughness of 10 MPa*m^½ or more, (iv) a porosity of the first hard material is in a range from 4 vol % to 15 vol %, and, a ratio of a Young's modulus of a second hard material constituting the cutting blade with respect to the Young's modulus of the first hard material constituting the roll surface is 1.3 or more.

7. The rotary cutter according to claim 6, wherein the ratio of the Young's modulus of the second hard material to the Young's modulus of the first hard material is in a range of from 1.3 to 1.64.

* * * * *